US007583811B2

(12) United States Patent
Wada

(10) Patent No.: US 7,583,811 B2
(45) Date of Patent: Sep. 1, 2009

(54) ELECTRO-OPTICAL DEVICE AND ELECTRONIC APPARATUS

(75) Inventor: Hiroshi Wada, Nagano (JP)

(73) Assignee: Seiko Epson Corporation (JP)

( * ) Notice: Subject to any disclaimer, the term of this patent is extended or adjusted under 35 U.S.C. 154(b) by 827 days.

(21) Appl. No.: 11/181,489

(22) Filed: Jul. 14, 2005

(65) Prior Publication Data

US 2006/0039575 A1 Feb. 23, 2006

(30) Foreign Application Priority Data

Aug. 23, 2004 (JP) ..... 2004-241929

(51) Int. Cl.
*H04R 25/00* (2006.01)

(52) U.S. Cl. ..... 381/388; 381/333; 381/190

(58) Field of Classification Search ..... 381/306, 381/333, 388, 152, 190, 345, 351; 379/433.02, 379/432; 310/322, 324; 455/90.3, 575.1
See application file for complete search history.

(56) References Cited

U.S. PATENT DOCUMENTS 4,352,961 A * 10/1982 Kumada et al. ..... 455/350
6,427,017 B1 7/2002 Toki
7,050,600 B2 * 5/2006 Saiki et al. ..... 381/388
2005/0111678 A1 * 5/2005 Wada et al. ..... 381/190

FOREIGN PATENT DOCUMENTS

| | | |
|---|---|---|
| JP | 2000-152385 | 5/2000 |
| JP | 2001-156899 | 6/2001 |
| JP | 2001-168963 | 6/2001 |
| JP | 2002-057769 | 2/2002 |
| JP | 2002-063986 | 2/2002 |
| JP | 2002-077346 | 3/2002 |
| JP | 2002-232542 | 8/2002 |
| JP | 2003-102094 | 4/2003 |
| JP | 2003-169118 | 6/2003 |
| JP | 2004-336293 | 11/2004 |
| WO | WO 2004/004408 | 1/2004 |

OTHER PUBLICATIONS

Examination result issued in corresponding Japanese application.
Communication from Korean Patent Office regarding related application.

* cited by examiner

*Primary Examiner*—Huyen D Le
(74) *Attorney, Agent, or Firm*—Harness, Dickey & Pierce, P.L.C.

(57) ABSTRACT

An electro-optical device includes an electro-optical panel, a sound-production frame that is disposed on a rear surface of the electro-optical panel and that constitutes a sound-production space, together with the electro-optical panel, and a sound-production vibrating body that is fixed directly to the sound-production frame in the sound-production space.

7 Claims, 5 Drawing Sheets

ELECTRO-OPTICAL DEVICE AND ELECTRONIC APPARATUS

RELATED APPLICATION

This application claims priority to Japanese Patent Application No. 2004-241929 filed Aug. 23, 2004 which is hereby expressly incorporated by reference herein in its entirety.

BACKGROUND OF THE INVENTION

1. Technical Field

The present invention relates to electro-optical devices and to electronic apparatuses. More particularly, the present invention relates to an electro-optical device that has a favorable sound-production function when being installed in a portable electronic apparatus.

2. Related Art

In general, electro-optical devices are installed in various electronic apparatuses as display bodies. Further, there are many cases in which the electro-optical devices are installed in various electronic apparatuses together with sound-production bodies, such as speakers or the like. In an electronic apparatus according to the related art, typically, an electro-optical device (for example, a liquid crystal display device) is housed in a case, while being separated from a sound-production body. For example, in a portable electronic apparatus, such as a cellular phone, the electro-optical device and the sound-production body are separately mounted on a substrate that is disposed in the case (for example, see Japanese Unexamined Patent Application Publication No. 2001-168963) or the electro-optical device and the sound-production body are directly fixed to separate places in the case (for example, see Japanese Unexamined Patent Application Publication No. 2002-77346).

Further, in order to reduce the size and the thickness, as the sound-production body installed in the above-described electronic apparatus, a piezoelectric sound-production body is used in which a piezoelectric vibrating body formed by laminating a vibration plate and a piezoelectric body is fixed to the case (for example, see Japanese Unexamined Patent Application Publication No. 2002-77346).

In recent years, with the progress of the reduction in size of portable electronic apparatus and the increased screen size of display devices, in the structure according to the related art, if a display section and a sound section are disposed to overlap each other, the thickness of the case is inevitably increased. On the other hand, when the display section and the sound section need to be disposed not to overlap each other for the sake of reducing the thickness of the case, the size of the apparatus is inevitably increased.

Further, when the sound-production body is disposed in the electronic apparatus, acoustic design in the vicinity of the sound-production body needs to be performed for each case. Accordingly, the design of the case may be restricted. Further, a sufficient reduction in size or thickness of the case cannot be achieved.

SUMMARY

An advantage of the invention is that it provides an electro-optical device on which an electro-optical panel and a sound-production body can be mounted compactly. Further, another advantage of the invention is that it provides an electro-optical device in which acoustic design of a sound-production body does not need to be performed for the case of an electronic apparatus in which the electro-optical device is installed.

According to an aspect of the invention, an electro-optical device includes an electro-optical panel, a sound-production frame that is disposed on a rear surface of the electro-optical panel and that constitutes a sound-production air space, together with the electro-optical panel, and a sound-production vibrating body that is fixed directly to the sound-production frame in the sound-production air space.

In accordance with the aspect of the invention, the sound-production frame disposed on the rear surface of the electro-optical panel constitutes the sound-production air space and the sound-production vibrating body is housed in the sound-production air space. Accordingly, the entire device can be constituted compactly. Further, since the sound-production vibrating body is fixed directly to the sound-production frame, acoustic design of the sound-production vibrating body can be performed in a holding body. If necessary, the relationship between the structure of the sound-production frame and the structure of the electro-optical panel may be considered. Therefore, an influence on sound by the design or internal configuration of a case of an electronic apparatus, in which the electro-optical device is installed, can be reduced. As a result, the design of the electronic apparatus, in which the electro-optical device is installed, can be performed unlimitedly. In addition, in the related art, even when the piezoelectric vibrating body is reduced in size and thickness, as described above, since the sound-production body has the structure in which the-sound-production vibrating body is housed in the case, the piezoelectric vibrating body has a significant volume, which obstructs the reduction in size of a portable electronic apparatus. In the aspect of the invention, since the sound-production vibrating body is mounted and fixed directly to a support body, a compact sound-production section can be implemented and thus the electro-optical device can be further reduced in size and thickness. Further, the number of parts can be reduced and thus a manufacturing cost can be reduced.

In the electro-optical device according to the aspect of the invention, it is preferable that, when the sound-production vibrating body is fixed to the sound-production frame, the sound-production air space is divided into front and back spaces. Accordingly, the interference between the sound waves occurring in front and back sides of the sound-production vibrating body based on the vibration of the sound-production vibrating body within the sound-production air space can be prevented. Therefore, sound can be efficiently generated.

In the electro-optical device according to the aspect of the invention, it is preferable that the sound-production vibrating body is disposed so as to overlap the electro-optical panel in plan view. According to this configuration, the sound-production vibrating body is disposed so as to overlap the electro-optical panel in plan view, and thus the planar size of the electro-optical device can be reduced.

In the electro-optical device according to the aspect of the invention, it is preferable that the sound-production vibrating body is a piezoelectric vibrating body that is a laminate of a vibration plate and a piezoelectric body. By using the piezoelectric vibrating body, the electro-optical device can be further reduced in size and thickness. In this case, an outer circumference of the vibration plate is fixed directly to the inner surface of the support body and thus the piezoelectric sound-production body can be constituted by the piezoelectric vibrating body and the support body.

The electro-optical device according to the aspect of the invention may further include a panel-holding frame that holds the electro-optical panel. In this case, it is preferable that the sound-production frame is mounted and fixed to the panel-holding frame. According to this configuration, the panel-holding frame that holds the electro-optical panel and the sound-production frame that is mounted and fixed to the panel-holding frame and that constitutes the sound-production air space are mounted and fixed to each other. Therefore, an assembling work or maintenance of the electro-optical device can be easily performed. Here, it is preferable that the sound-production frame is detachably fixed to the panel-holding frame. As a detachable fixing structure, a hook-engagement, press-fit fixing, screw fixing, or the like may be exemplified.

The electro-optical device according to the aspect of the invention may further includes a support member that is interposed between the panel-holding frame and the sound-production frame and that defines the sound-production air space. According to this configuration, the sound-production air space can be constituted between the panel-holding frame and the sound-production frame via the support member, and thus the structure and airtightness of the air space can be secured via the support member. Therefore, the sound-production air space can be designed without being limited by the structure of the panel-holding frame or the sound-production frame and thus acoustic design can be easily achieved. Further, a degree of freedom for the structural size of the panel-holding frame or the sound-production frame, or the mounting and fixing structure of the panel-holding frame and the sound-production frame can be secured.

In the electro-optical device according to the aspect of the invention, it is preferable that, in the sound-production frame, a fixed inner surface portion that fixes an outer circumference of the sound-production vibrating body and an opposing inner surface portion that faces a vibration side of the sound-production vibrating body are provided. In this case, the opposing inner surface portion may be separated by a space from the vibration side of the sound-production vibrating body. According to this configuration, the outer circumference of the sound-production vibrating body is fixed to the fixed inner surface portion and the opposing inner surface portion faces the vibration side of the sound-production vibrating body while being separated therefrom. Therefore, the sound-production vibrating body can be reliably mounted and fixed, without interrupting the vibration of the sound-production vibrating body.

In the electro-optical device according to the aspect of the invention, it is preferable that a step is provided between the fixed inner surface-portion and the opposing inner surface portion, such that the opposing inner-surface portion is separated further from the vibration side of the sound-production vibrating body than from the fixed inner surface portion. According to this configuration, the step is provided between the fixed inner surface portion and the opposing inner surface portion. Therefore, while the outer circumference of the sound-production vibrating body is mounted and fixed to the fixed inner surface portion, the vibration side of the sound-production vibrating body can be reliably separated from the opposing inner surface portion.

In the electro-optical device according to the aspect of the invention, it is preferable that a protrusion is formed in the periphery of the opposing inner surface portion, and the fixed inner surface portion is constituted by an upper surface of the protrusion. According to this configuration, the protrusion is provided on the inner surface of the sound-production frame and the sound-production vibrating body is fixed to the protrusion.

Moreover, in the support body according to the aspect of the invention, when the opposing inner surface portion is separated from the vibration side of the sound-production vibrating body, a wall portion of a region where the opposing inner surface portion is provided may be protruded outward than a wall portion of a region where the fixed inner surface portion is provided. Further, outer surfaces of both wall portions may be flat. Further, the step may be constituted by allowing the fixed inner surface portion to be protruded inward than the periphery thereof.

In the electro-optical device according to the aspect of the invention, it is preferable that an air inlet is provided in the opposing inner surface portion. According to this configuration, with the air inlet, when the sound waves are generated in the sound-production air space by the vibration of the sound-production vibrating body, there is no case in which the vibration of the sound-production vibrating body is suppressed.

Further, according to anther aspect of the invention, an electronic apparatus includes the electro-optical device described above, and a control unit that controls the electro-optical device. According to this configuration, since the electro-optical device with the sound-production function can be housed in the electronic apparatus compactly, the electronic apparatus can be reduced in size and thickness. Here, as an electronic apparatus to which the invention can be applied, in particular, a portable electronic apparatus that is needed to be reduced in size is effectively used. As the portable electronic apparatus, a cellular phone, a portable information terminal, an electronic watch, or the like can be exemplified.

BRIEF DESCRIPTION OF THE DRAWINGS

The invention will be described with reference to the accompanying drawings, wherein like numbers reference like elements, and wherein.

DESCRIPTION OF THE EMBODIMENTS

Next, embodiments of the invention will be described in detail with reference to the accompanying drawings. Here, the respective embodiments described below are just examples of the invention and the descriptions thereof are not intended to limit the invention.

First Embodiment

Figure 1A:
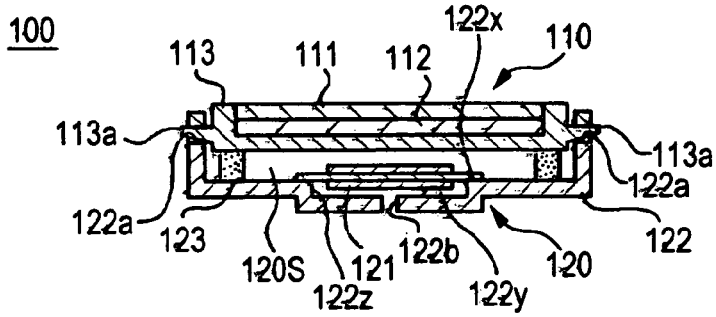
FIG. 1A is a cross-sectional view of an electro-optical device according to a first embodiment of the invention.
Figure 1B:
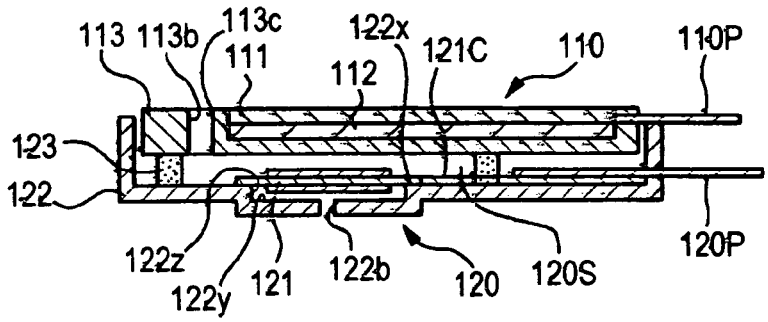
FIG. 1B is a cross-sectional view of the electro-optical device according to the first embodiment of the invention.
Figure 1C:
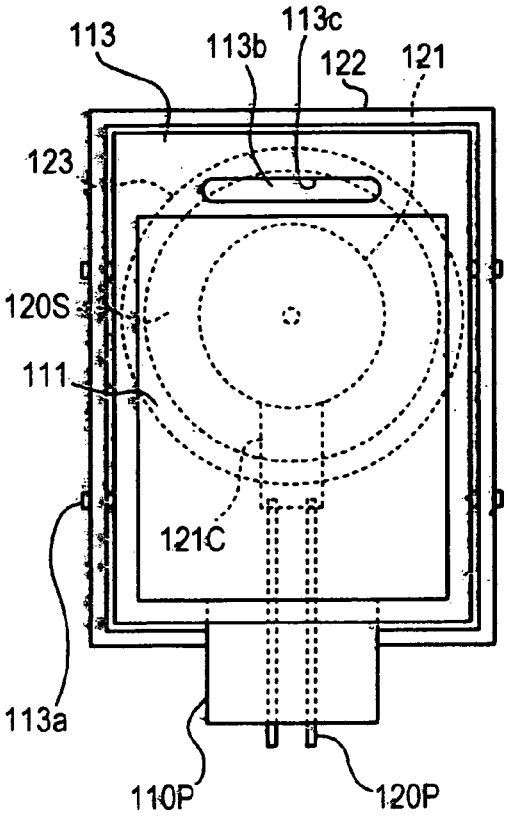
FIG. 1C is a plan view of the electro-optical device according to the first embodiment of the invention.
Figure 1D:
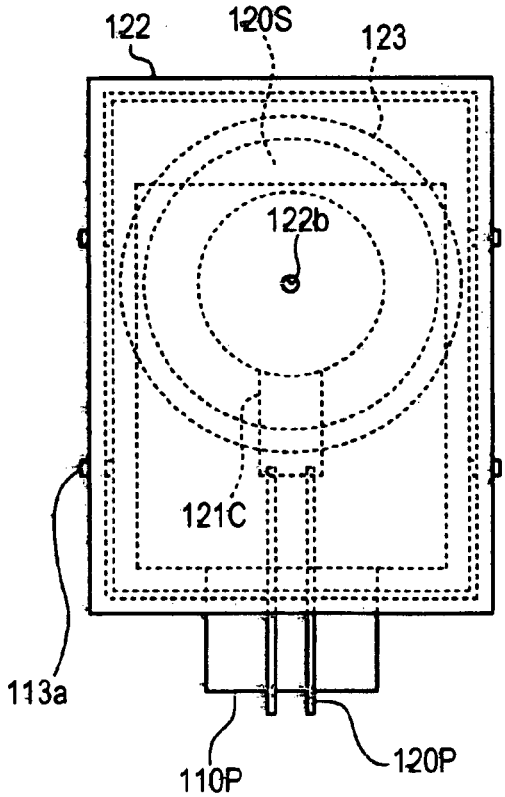
FIG. 1D is a bottom view of the electro-optical device according to the first embodiment of the invention.

FIG. 1A is a cross-sectional view taken along one direction (short-side direction) of an electro-optical device 100 according to the invention. FIG. 1B is a cross-sectional view taken along the other direction (long-side direction) of the electro-optical device 100. FIG. 1C is a plan view showing the electro-optical device 100. FIG. 1D is a bottom view showing the electro-optical device 100. The electro-optical device 100 includes a display section 110 that has an electro-optical panel 111 and a sound-production section 120 that has a sound-production vibrating body 121.

The electro-optical panel 111 is constituted by anyone of various electro-optical panels, such as a liquid crystal display panel, an organic electroluminescent panel, a plasma display panel, a field emission panel, and the like. In the present specification, it is assumed that a liquid crystal display panel is used. A backlight 112 that illuminates the electro-optical panel 111 from the back is disposed in the display section 110. Moreover, when a self-emitting-type panel is used as the electro-optical panel 111, instead of the liquid crystal display panel, a backlight needs not be used.

A panel-holding frame 113 is provided in the display section 110, and the electro-optical panel 111 and the backlight 112 are held and fixed by the panel-holding frame 113. A wiring line member 110P constituted by a flexible wiring board or the like is connected to the display section 110 and is led outside the panel-holding frame 113. The wiring line member 110P supplies power or control signals to the electro-optical panel 111 or the backlight 112. In the panel-holding frame 113, a sound guiding path 113*b*, which is connected to a sound-production air space 120S to be described below, is provided. The sound guiding path 113*b* opens at the upper surface of the electro-optical device 100 through which the display surface of the electro-optical panel 111 is exposed.

In the sound-production section 120, the sound-production vibrating body 121 and a sound-production frame 122 that constitute the sound-production air space 120S for housing the sound-production vibrating body 121 are provided. The sound-production vibrating body 121 is a vibrating body that generates sound waves. In this case, unlike a related art speaker, a case or support body that fixes or houses the vibrating body is not provided. The sound-production frame 122 houses the sound-production vibrating body 121 and is detachably fixed to the panel-holding frame 113 of the display section 110. More specifically, engaging protrusions 113*a* are provided on outer surfaces of the panel-holding frame 113 and engaging openings 122*a* are provided in side walls of the sound-production frame 122. The engaging protrusions 113*a* are engaged with (fitted into) the engaging openings 122*a*, such that the sound-production frame 122 is attached and fixed to the panel-holding frame 113. Further, a wiring line member 120P is connected to the sound-production section 120 and is led outside the sound-production frame 122. The wiring line member 120P supplies a driving signal to the sound-production vibrating body 121.

A support member 123 is disposed between the panel-holding frame 113 and the sound-production frame 122 so as to define the sound-production air space 120S. The support member 123 is disposed in a closed curved shape (in the drawing, a ring shape) between the panel-holding frame 113 and the sound-production frame 122. The inside of the closed curved shape constitutes the sound-production air space 120S. The support member 123 is preferably made of an elastic material or a buffering material, such as synthetic resin or flexible synthetic resin (for example, urethane foam), such that rattling does not occur between the panel-holding frame 113 and the sound-production frame 122. Moreover, the present invention is not limited to the present embodiment. Rattling of the support member between the panel-holding frame 113 and the sound-production frame 122 causes undesirable noise and loss of vibration energy of the sound-production vibrating body (piezoelectric vibrating body) 121, and thus it is preferable to reduce rattling as much as possible.

Figure 7A:
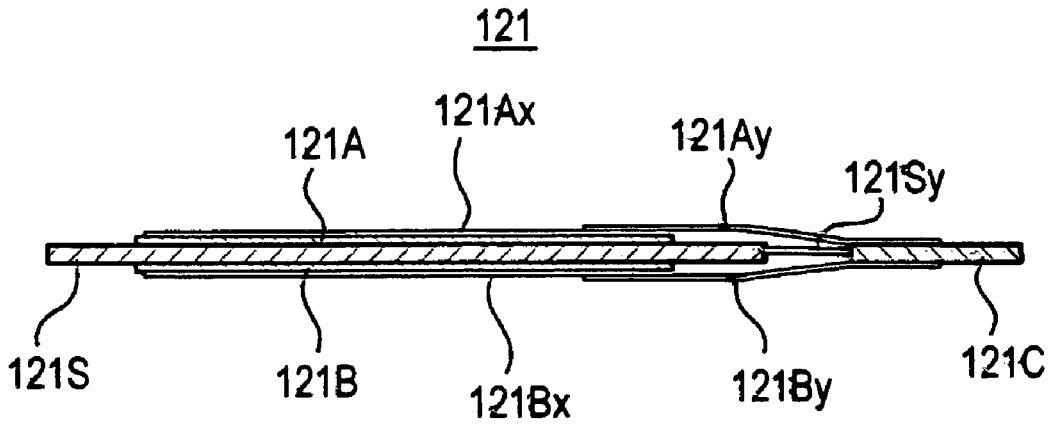
FIG. 7A is a longitudinal cross-sectional view of a piezoelectric vibrating body.
Figure 7B:
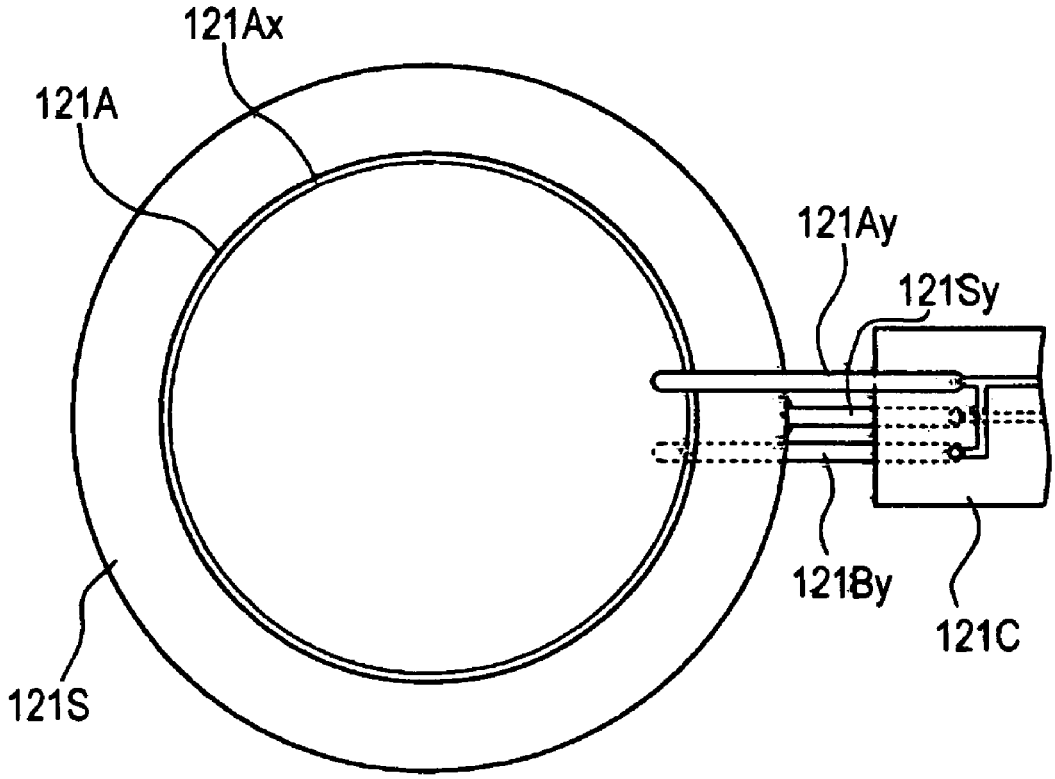
FIG. 7B is a plan view of a piezoelectric vibrating body.

The sound-production vibrating body 121 includes a piezoelectric vibrating body that constitutes a main body of a piezoelectric speaker, for example. As shown in FIGS. 7A and 7B, the piezoelectric vibrating body is a laminate of a vibration plate 121S (shim plate) made of stainless steel or the like, and piezoelectric bodies 121A and 121B. FIGS. 7A and 7B show a bimorph piezoelectric vibrating body in which the piezoelectric bodies 121A and 121B are laminated on front and back sides of the vibration plate 121S. Of course, a unimorph piezoelectric vibrating body may be used. On the surfaces of the piezoelectric bodies 121A and 121B, electrodes 121Ax and 121Bx made of metal films of gold (Au) or the like, are formed. Conductive pieces l21Ay and 121By made of aluminum or the like are connected to the electrodes 121Ax and 121Bx. The conductive pieces 121Ay and 121By are connected to a wiring line member 121C, such as a flexible wiring board or the like. Further, a conductive piece 121Sy is connected to the vibration plate 121S and, similarly, is connected to the wiring line member 121C. The wiring line member 121C is connected to the wiring line member 120P. Moreover, the wiring line member 121C and the wiring line member 120P may be integrally formed.

In the present embodiment, the sound-production vibrating body 121 is fixed directly onto the inner surface of the bottom portion of the sound-production frame 122. Specifically, an outer edge of the vibration plate 121S of the sound-production vibrating body 121 is attached and fixed onto the inner surface of the sound-production frame 122. The outer circumference of the vibration plate 121S and the inner surface of the sound-production frame 122 are fixed directly to each other via an adhesive or the like. On the inner surface of the sound-production frame 122, a fixed inner surface portion 122*x*, to which the sound-production vibrating body 121 is fixed, and an opposing inner surface portion 122*y* that is provided inside the fixed inner surface portion 122*x* so as to face a vibration side (surface) of the sound-production vibrating body 121 are provided. The opposing inner surface portion 122*y* is configured to be separated by a space from the vibration side of the sound-production vibrating body 121, that is, such that a gap exists between the surface of the sound-production vibrating body 121 and the opposing inner surface portion 122*y*. In the drawing, a step 122*z* is provided between the fixed inner surface portion 122*x* and the opposing inner surface portion 122*y*. Due to the step 122*z*, the opposing inner surface portion 122*y* is disposed lower than the fixed inner surface portion 122*x*.

Moreover, in the drawing, with respect to the outer surface of the wall surface on which the fixed inner surface portion 122*x* is provided, the outer surface of the wall surface on which the opposing inner surface portion 122*y* is provided protrudes downward. Here, the outer surfaces are flat.

In the present specification, the sound-production air space 120S means a space that houses the sound-production vibrating body 121 and in which sound waves are generated directly through the vibration of the sound-production vibrating body 121. In the drawing, the outer circumference of the sound-production vibrating body 121 (the vibration plate 121S) is fixed airtight to the fixed inner surface portion 122*x* over the entire circumference. Accordingly, the sound-production air space 120S is divided into an upper space between the sound-production vibrating body 121 and the bottom surface of the panel-holding body 113 and a lower space between the sound-production vibrating body 121 and the opposing inner surface portion 122*y*.

The upper space of the sound-production air space 120S is connected to a sound releasing hole 113*c*, which is disposed upward, via the sound guiding path 113*b* provided in the panel-holding frame 113. Sound generated by the vibration of the sound-production vibrating body 121 is released from the sound releasing hole 113*c* above the display section 110.

Further, an air inlet 122*b* is provided in the opposing inner surface portion 122*y*. As shown in the drawing, the air inlet 122*b* is preferably formed at the center of the opposing inner surface portion 122*y*. Further, as shown in the drawing, a single air inlet 122*b* may be formed. Alternatively, the air inlet 122*b* may be constituted by a plurality of small holes. Here, if the air inlet 122*b* is not provided, the lower space of the sound-production air space 120S becomes the closed space. In this case, if the volume of the lower space is not sufficiently large, the pressure of air in the lower space is increased by the vibration when the vibration amplitude of the vibration plate is increased. If doing so, the vibration amplitude of the vibration plate is depressed due to the pressure, and thus the sound may not be turned up. If the air inlet 122*b* is formed in the lower space, even when the vibration amplitude of the vibration plate is increased, there is no case in which the vibration amplitude of the vibrating body is depressed, since air moves via the air inlet 122*b*. At this time, sound is generated from the air inlet 122*b*, but this sound is not used.

Moreover, if the lower space has a sufficient volume, the air inlet 122*b* need not be provided. Further, in order to use the sound from the air inlet 122*b*, the sound guiding path 113*b* and the sound releasing hole 113*c* need not be provided as long as the upper space has a sufficient volume.

The acoustic effect of the sound-production section 120 is suitably designed by adjusting the shape or volume of the sound releasing hole, the sound guiding path, or the sound-production air space 120S, and the shape or volume of the upper space or the lower space.

Further, in the present embodiment, the sound-production vibrating body 121 is disposed to overlap the electro-optical panel 111 in plan view. More specifically, the overall sound-production vibrating body 121 overlaps the electro-optical panel 111 in plan view. Accordingly, the planar size of the electro-optical device 100 can be made small. In the present invention, the electro-optical panel 111 and the sound-production vibrating body 121 need not overlap each other in plan view.

In the present embodiment, the display-section 110 having the electro-optical panel 111 and the sound-production section 120 are integrally constituted, and thus a compact electro-optical device 100 can be implemented. Further, since the electro-optical panel and the sound-production body do not need to be separately installed in an electronic apparatus, unlike the related art, an electronic apparatuses in which the electro-optical device 100 is installed can be reduced in size or thickness. Further, the acoustic effect of the sound-production section 120 is determined by the structure of the electro-optical device 100, and thus the acoustic effect can be prevented from changing according to the arrangement of the sound-production body in the electronic apparatus, unlike the related art. Therefore, acoustic design can be easily achieved and stable sound characteristics can be obtained even when the sound-production body is installed in any electronic apparatus.

Further, in the sound-production section 120, the sound-production vibrating body 121 is fixed directly to the support body between the panel-holding frame 113 and the sound-production frame 122. Therefore, the sound-production vibrating body that includes a case for housing the sound-production vibrating body does not need to be separately provided. As a result, a more compact sound-production section 120 can be implemented, and the number of parts can be reduced.

In particular, since the gap is provided between the vibration side of the sound-production vibrating body and the opposing inner surface portion 122*y*, there is no case in which the vibration of the sound-production vibrating body is interrupted, such that the sound waves can be generated in the gap. In this case, when the step 122*z* is provided between the fixed inner surface portion 122*x* and the opposing inner surface portion 122*y*, the gap can be secured along the entire vibration side. Further, in order to secure a sufficient volume of the sound emitted from the sound releasing hole 122*b*, it is necessary to adjust the gap, but it is convenient to provide the step 122*z* in view of optimization of the gap.

Second Embodiment

Figure 2:
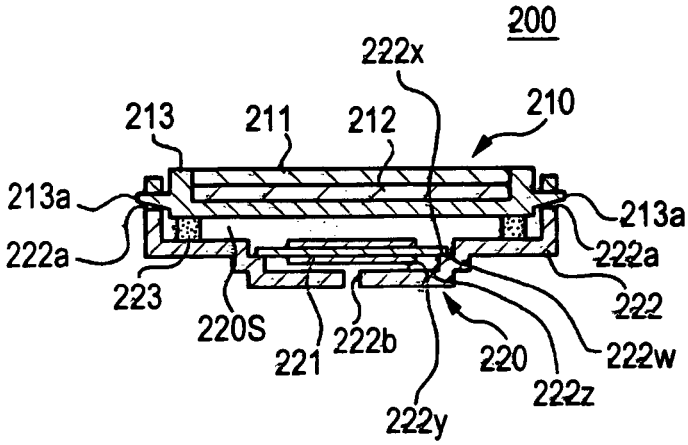
FIG. 2 is a cross-sectional view of an electro-optical device according to a second embodiment of the invention.

Next, a second embodiment according to the invention will be described with reference to FIG. 2. FIG. 2 is a cross-sectional view taken along one direction (short-side direction) of the electro-optical device 200 according to the second embodiment of the invention. Other parts, which are not shown in FIG. 2, can be constituted similarly to those in the above-described first embodiment and thus the descriptions thereof will be omitted.

The electro-optical device 200 of this embodiment includes a display section 210 having an electro-optical panel 211 and a sound-production section 220 having a sound-production vibrating body 221. Here, the electro-optical panel 211, a backlight 212, a panel-holding frame 213, the sound-production vibrating body 221, and a support member 223 are the same as those in the first embodiment and thus the descriptions thereof will be omitted.

In a sound-production frame 222 of the present embodiment, a fixed inner surface portion 222*x* that fixes the sound-production vibrating body 221 and an opposing inner surface portion 222*y* that faces the vibration side of the sound-production vibrating body 221 are provided. The second embodiment is the same as the first embodiment in that a step 222*z* is provided between the fixed inner surface portion 222*x* and the opposing inner surface portion 222*y*, but is different from the first embodiment in that a step 222*w* is formed in the periphery of the fixed inner surface portion 222*x* and the fixed inner surface portion 222*x* is provided at a position that is lowered by one step from the inner bottom surface of the periphery thereof. As such, when the fixed inner surface portion 222*x* is constituted to be lowered by one step, the thickness of the sound-production section 220, excluding a portion where the sound-production vibrating body 221 of the sound-production section 220 is housed, can be reduced and thus the volume of the sound-production 220 can be reduced. Further, like the first embodiment, in the present embodiment, the support member 223 is disposed between the panel-holding frame 213 and the sound-production frame 222. Alternatively, like the present embodiment, when the fixed inner surface portion 222*x* is lowered from the inner portion of the periphery thereof, a sound-production air space 220S may be constituted by only the panel-holding frame 213 and the sound-production frame 222, without disposing the support member 223 therebetween.

Third Embodiment

Figure 3:
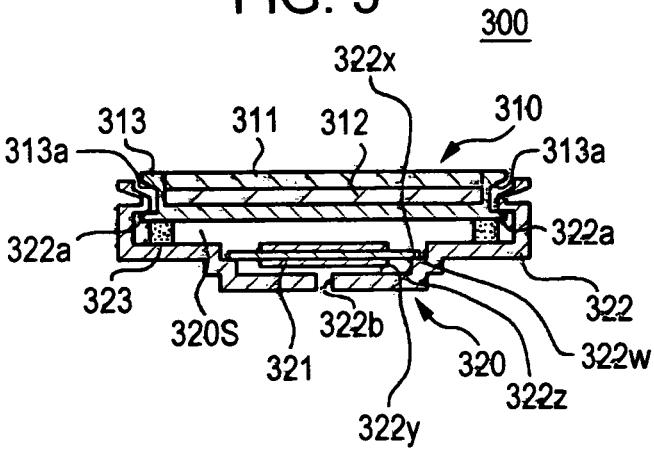
FIG. 3 is a cross-sectional view of an electro-optical device according to a third embodiment of the invention.

Next, a third embodiment according to the invention will be described with reference to FIG. 3. FIG. 3 is a cross-sectional view taken along one direction (short-side direction) of an electro-optical device 300 according to the third embodiment of the invention. In the present embodiment, other parts, which are not shown in FIG. 3, can be constituted similarly to those in the above-described first embodiment and thus the descriptions thereof will be omitted.

The electro-optical device 300 of this embodiment includes a display section 310 having an electro-optical panel 311 and a sound-production section 320 having a sound-production vibrating body 321. Here, the electro-optical panel 311, a backlight 312, the sound-production vibrating body 321, and a support member 323 are the same as those in the-second embodiment and thus the descriptions thereof will be omitted.

In this embodiment, a panel-holding frame 313 and a sound-production frame 322 are substantially the same as those in the second embodiment and a mounting and fixing structure of the panel-holding frame 313 and the sound-production frame 322 is different from that in the above-described embodiment. In the present embodiment, in outer surfaces of the panel-holding frame 313, engaging concave portions 313*a* are formed. Further, on side walls of the sound-production frame 322, engaging protrusions 322*a* are provided to protrude inward. Therefore, if the sound-production frame 322 is fitted into the panel-holding frame 313 from the back, the engaging protrusions 322*a* are elastically engaged with (fitted into) the engaging concave portions 313*a*.

Like the above-described embodiments or the present embodiment, when the mounting and fixing structure of the panel-holding frame and the sound-production frame is a structure in which the panel-holding frame and the sound-production frame are elastically engaged with (fitted into) each other, an assembling work can be very easily performed. Further, if there is any problem, the sound-production frame can be separated from the panel-holding frame during manufacturing.

Fourth Embodiment

Figure 4:
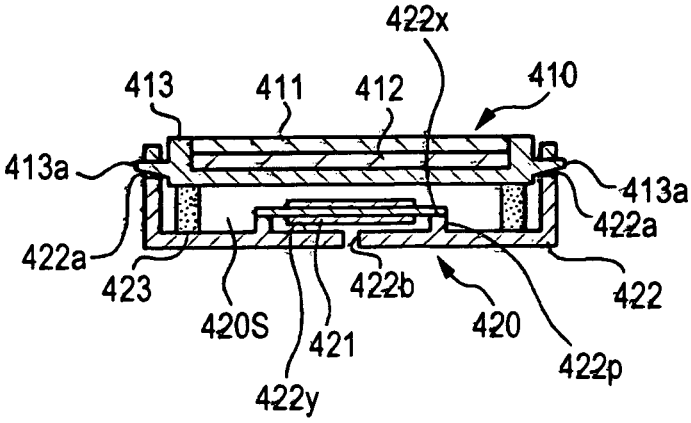
FIG. 4 is a cross-sectional view of an electro-optical device according to a fourth embodiment of the invention.

Next, a fourth embodiment according to the invention will be described with reference to FIG. 4. FIG. 4 is a cross-sectional view taken along one direction (short-side direction) of an electro-optical device 400 according to the fourth embodiment of the invention. In the present embodiment, other parts, which are not shown in FIG. 4, can be constituted similarly to those in the above-described first embodiment and thus the descriptions thereof will be omitted.

The electro-optical device 400 of this embodiment includes a display section 410 having an electro-optical panel 411 and a sound-production section 420 having a sound-production vibrating body 421. Here, the electro-optical panel 411, a backlight 412, a panel-holding frame 413, the sound-production vibrating body 421, and a support member 423 are the same as those in the first embodiment and thus the descriptions thereof will be omitted.

In this embodiment, an outer bottom surface of a sound-production frame 422 is flat. Further, an inner bottom surface of the sound-production frame 422 is also flat, but a ring-shaped protrusion (rib) 422*p* that protrudes inward is provided on a portion of the inner bottom surface. At this time, the upper surface of the protrusion 422*p* serves as a fixed inner surface portion 422*x*. Thus, an inner surface portion at an inner circumference of the fixed inner surface portion 422*x* serves as an opposing inner surface portion 422*y*.

In this embodiment, since the outer bottom surface of the sound-production frame 422 is flat, ease of handling can be achieved during a manufacturing process. Further, when the electro-optical device 400 is provided in an electronic apparatus, a gap between the sound-production body 422 and another underlying part (substrate or the like) can be easily secured. Therefore, sound waves emitted from a sound releasing hole 422*b* can be easily transferred to the outside.

Fifth Embodiment

Figure 5:
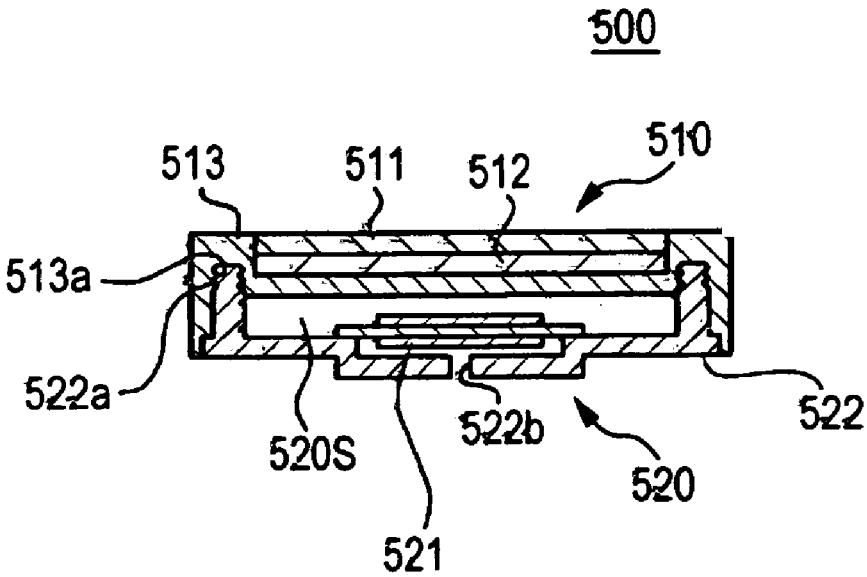
FIG. 5 is a cross-sectional view of an electro-optical device according to a fifth embodiment of the invention.

Next, a fifth embodiment according to the invention will be described with reference to FIG. 5. FIG. 5 is a cross-sectional view taken along one direction (short-side direction) of an electro-optical device 500 according to the fifth embodiment of the invention. In the present embodiment, other parts, which are not shown in FIG. 5, can be constituted similarly to those in the above-described first embodiment and thus the descriptions thereof will be omitted.

The electro-optical device 500 of this embodiment includes a display section 510 having an electro-optical panel 511 and a sound-production section 520 having a sound-production vibrating body 521. Here, the electro-optical panel 511 and a backlight 512 are the same as those in the first embodiment and thus the descriptions thereof will be omitted.

In this embodiment, a panel-holding frame 513 and a sound-production frame 522 are combined with each other via a screw structure. The screw structure has ring-shaped screw grooves 513*a* provided in the panel-holding frame 513 and ring-shaped screw frames 522*a* provided on the sound-production frame 522. Then, by rotating the sound-production frame 522 with respect to the panel-holding frame 513, the ring-shaped screw grooves 513*a* and the ring-shaped screw frames 522*a* are combined with each other, such that the sound-production frame 522 is mounted and fixed to the panel-holding frame 513. Further, the screws can be simply loosened and removed.

In the present embodiment, the panel-holding frame 513 and the sound-production frame 522 are detachably constituted via the screw structure, and thus the assembling work can be easily performed, like the above-described embodiment. Further, when the panel-holding frame 513 and the sound-production frame 522 are mounted and fixed to each other, both can be fixed airtight. Therefore, the support member does not need to be used, unlike the above-described embodiments, and the number of parts can be reduced. As a result, the assembling work can be easily performed.

Sixth Embodiment

Figure 6:
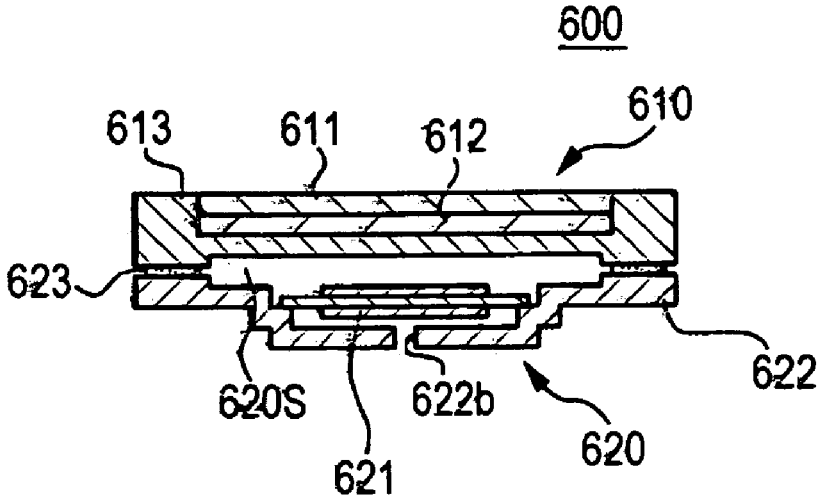
FIG. 6 is a cross-sectional view of an electro-optical device according to a sixth embodiment of the invention.

Next, a sixth embodiment according to the invention will be described with reference to FIG. 6. FIG. 6 is a cross-sectional view taken along one direction (short-side direction) of an electro-optical device 600 according to the sixth embodiment of the invention. In the present embodiment, other parts, which are not shown in FIG. 6, can be constituted similarly to those in the above-described first embodiment and thus the descriptions thereof will be omitted.

The electro-optical device 600 of this embodiment includes a display section 610 having an electro-optical panel 611 and a sound-production section 620 having a sound-production vibrating body 621. Here, the electro-optical panel 611, a backlight 612, and the sound-production vibrating body 621 are the same as those in the first embodiment and thus the descriptions thereof will be omitted.

In this embodiment, a panel-holding frame 613 and a sound-production frame 622 are adhered and fixed to each other via an adhesive 623. The adhesive 623 may generally include an acryl-based adhesive or an epoxy-based adhesive. Here, the panel-holding frame 613 and the sound-production frame 622 may be indirectly attached to each other via the support member in the respective embodiments described above. In addition, the panel-holding frame 613 and the sound-production frame 622 may be fixed to each other through a direct deposition, welding, or the like.

In the present embodiment, once if the panel-holding frame 613 and the sound-production frame 622 are fixed to each other, it is impossible to separate them from each other, but both can be reliably mounted and fixed to each other. Further, a support body that is constituted by the panel-holding frame 613 and the sound-production frame 622 can have increased rigidity, such that rattling or the like does not occur.

Seventh Embodiment

An electronic apparatus of a seventh embodiment according to the invention, in which the above-described electro-optical device is installed, will be described with reference to FIGS. 8 and 9. In this embodiment, an electronic apparatus that has the above-described electro-optical device 100 as a display unit will be described. Here, the electro-optical devices according to other embodiments can be applied to the present embodiment, like the electro-optical device 100.

Figure 8:
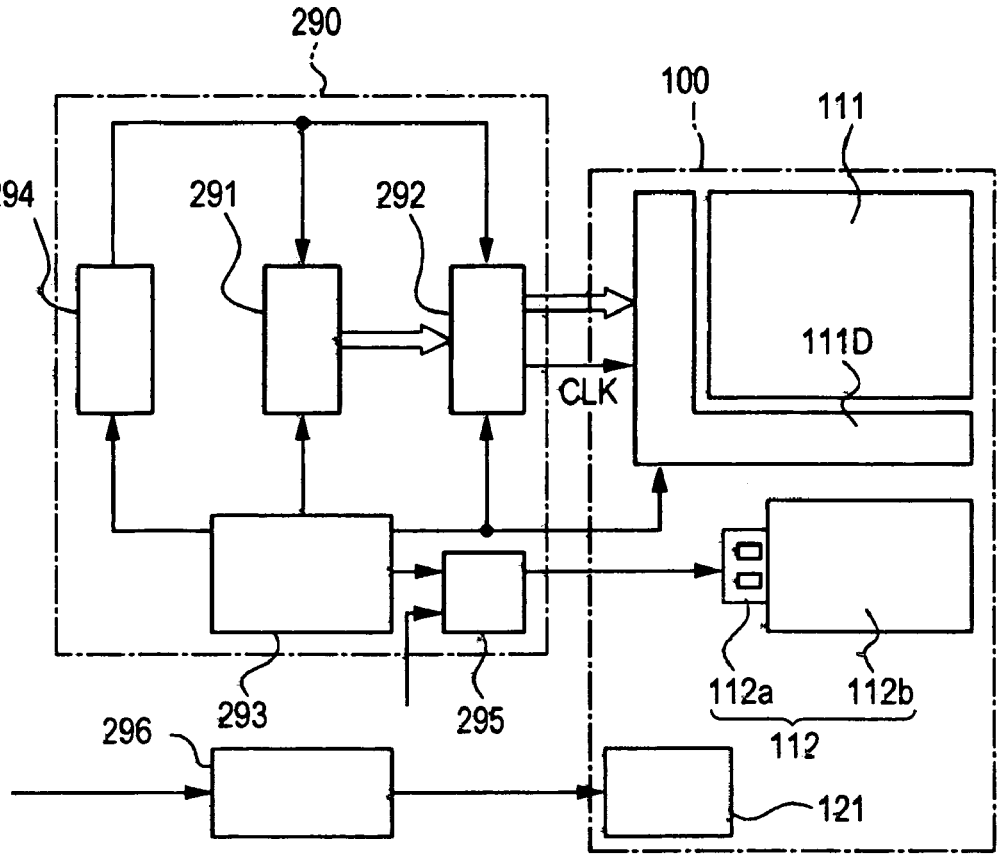
FIG. 8 is a diagram schematically showing the configuration of a control system in an electronic apparatus according to a seventh embodiment of the invention.

FIG. 8 is a diagram schematically showing the overall configuration of a control system (display control system) with respect to the electro-optical device 100 in the electronic apparatus of the present embodiment. The electronic apparatus shown in FIG. 8 has a display control circuit 290 that includes a display information output source 291, a display information processing circuit 292, a power supply 293, a timing generator 294, and a light-source control circuit 295.

Further, in the above-described electro-optical device 100, a driving circuit 111D that drives the electro-optical panel 111 having the above-described configuration is provided. The driving circuit 111D is constituted by electronic parts (semiconductor IC and the like) that are mounted directly on the electro-optical panel 111. Here, in addition to the above-described configuration, the driving circuit 111D may be constituted by a circuit pattern formed on the surface of the panel or a semiconductor IC chip or circuit pattern mounted on a circuit board that is electrically connected to a liquid crystal panel.

The display information output source 291 includes a memory that has the ROM (Read Only Memory), the RAM (Random Access Memory), or the like, a storage unit that has a magnetic recording disc, an optical recording disc, or the like, and a tuning circuit that synchronously outputs digital image signals. The display information output source 291 is constituted to supply display information to the display information processing circuit 292 in a shape of an image signal having a predetermined format based on various clock signals generated by the timing generator 294.

The display information processing circuit 292 includes various known circuits, such as a serial-parallel conversion circuit, an amplification/inversion circuit, a rotation circuit, a gamma correction circuit, a clamping circuit, and the like. The display information processing circuit 292 processes the input display information and supplies resultant image information to the driving circuit 111D, together with a clock signal CLK. The driving circuit 111D includes a scanning line driving circuit, a signal line driving circuit, and a test circuit. Further, the power supply 293 supplies predetermined power to the respective parts described above.

The light-source control circuit 295 supplies power supplied from the power supply 293 to a light-source section 112*a* of the backlight 112 based on a control signal from the outside. Light emitted from the light-source section 112*a* is incident on a light guiding plate 112*b* and is irradiated from the light guiding plate 112*b* onto the electro-optical panel 111. The light-source control circuit 295 controls turning-on or -off of each light source of the light-source section 112*a* according to the control signal. Further, the light-source control circuit 295 may control the luminance of each light source.

Further, a sound signal output circuit 296 is provided in the electronic apparatus of the present embodiment. The sound signal output circuit 296 sends a sound signal to the sound-production vibrating body 121 based on a control signal from a control circuit (not shown). In the sound-production vibrating body 121, the vibration is generated based on the sound signal to be supplied and the sound is outputted based on the vibration.

Figure 9:
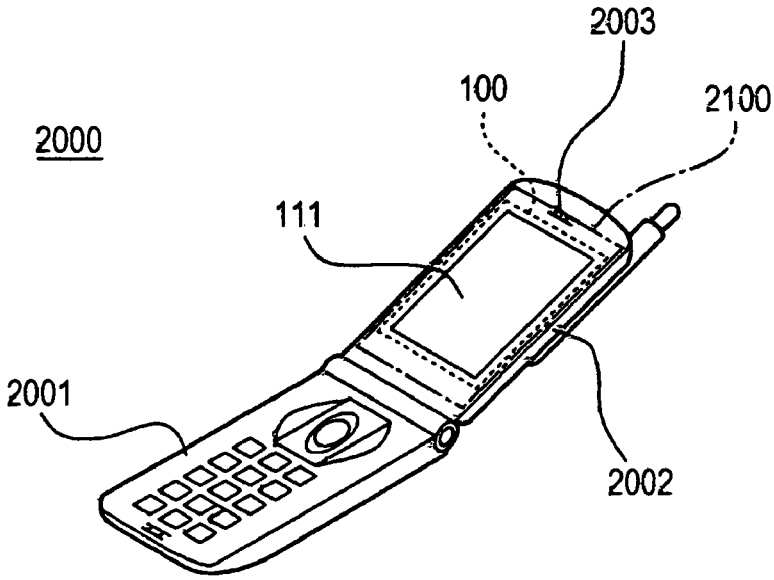
FIG. 9 is a perspective view of the electronic apparatus according to the seventh embodiment of the invention.

FIG. 9 shows an external appearance of a cellular phone that is an embodiment of the electronic apparatus according to the invention. The electronic apparatus 2000 has an operating section 2001 and a display section 2002. Inside the case of the display section 2002, a circuit board 2100 is disposed. The above-described electro-optical device 100 is mounted on the circuit board 2100. Then, the above-described liquid crystal panel 111 can be viewed through the surface of the display section 2002. Further, a sound output slot 2003 is provided in the display section 2002. The sound output slot 2003 is constituted such that the sound outputted from the sound-production body 121 to be emitted from the sound releasing hole or to be guided via the sound guiding path can be heard through the inside the case of the display section 2002.

Moreover, it should be understood that the electro-optical device with the sound-production body and the electronic apparatus of the invention are not limited to the above-described embodiments, but various changes can be made within the scope without departing from the subject matter of the invention. For example, though the piezoelectric vibrating body is used as the sound-production vibrating body in the respective embodiments described above, the present invention is not limited to the piezoelectric vibrating body. For example, a suitable vibrating body, such as a vibration plate of an electromagnetic speaker, or the like, may be used as long as it generates sound waves. Further, though the sound-production vibrating body is fixed to the sound-production frame in the respective embodiments described above, the sound-production vibrating body may be fixed to the panel-holding frame (for example, the bottom surface thereof). In this case, of course, the fixed inner surface portion and the opposing inner surface portion are formed on the panel-holding frame.

What is claimed is:

1. An electro-optical device comprising:

an electro-optical panel including a rear surface;

a sound-production frame that is disposed at the rear surface of the electro-optical panel, the sound-production frame defining at least part of a sound-production space located between the sound-production frame and the rear surface of the electro-optical panel; and a sound-production vibrating body that is fixed directly to the sound-production frame at a position within the sound-production space so as to divide the sound-production space into two different open spaces;

wherein the sound-production frame includes:

a fixing inner surface portion to which the sound-production vibrating body is fixed; and an opposing inner surface portion that faces a vibration side of the sound-production vibrating body separated by a space. the opposing inner surface portion being formed with a protrusion. and the fixing inner surface portion including an upper surface of the protrusion.

2. The electro-optical device according to claim 1, wherein the sound-production vibrating body is disposed so as to overlap the electro-optical panel in plan view.

3. The electro-optical device according to claim 1, wherein the sound-production vibrating body is a piezoelectric vibrating body including a vibrating plate and a piezoelectric body stacked on each other.

4. The electro-optical device according to claim 1, further comprising a panel-holding frame that holds the electro-optical panel, the sound-production frame being a separate member from and being fixed to the panel-holding frame.

5. The electro-optical device according to claim 4, further comprising a support member that is interposed between the panel-holding frame and the sound-production frame and that defines the sound-production space with the sound-production frame.

6. The electro-optical device according to claim 1, wherein the opposing inner surface portion includes an air inlet.

7. An electronic apparatus comprising: the electro-optical device according to claim 1; and a control unit that controls the electro-optical device.

* * * * *